US007850271B2

(12) United States Patent
Gothait et al.

(10) Patent No.: US 7,850,271 B2
(45) Date of Patent: Dec. 14, 2010

(54) INKJET PRINTING SYSTEM WITH MOVABLE PRINT HEADS AND METHODS THEREOF

(75) Inventors: Hanan Gothait, Rehovot (IL); Ran Asher Peleg, Kefar-Saba (IL)

(73) Assignee: Xjet Ltd, Rehovot (IL)

( * ) Notice: Subject to any disclaimer, the term of this patent is extended or adjusted under 35 U.S.C. 154(b) by 200 days.

(21) Appl. No.: 12/134,294

(22) Filed: Jun. 6, 2008

(65) Prior Publication Data

US 2008/0314276 A1 Dec. 25, 2008

Related U.S. Application Data

(63) Continuation of application No. PCT/IL2007/001468, filed on Nov. 28, 2007.

(60) Provisional application No. 60/687,423, filed on Nov. 28, 2006.

(51) Int. Cl.
*B41J 29/38* (2006.01)
*B41J 2/165* (2006.01)
*B41J 2/155* (2006.01)

(52) U.S. Cl. ..... 347/14; 347/22; 347/13; 347/42

(58) Field of Classification Search ..... 347/5, 347/13, 14, 19, 22, 41, 42, 43; 358/1.8, 296
See application file for complete search history.

(56) References Cited

U.S. PATENT DOCUMENTS

| | | | | |
|---|---|---|---|---|
| 6,293,648 | B1 | 9/2001 | Anderson | |
| 6,585,347 | B1 | 7/2003 | Johnson et al. | |
| 6,739,687 | B1 | 5/2004 | Rasmussen et al. | |
| 6,814,421 | B2 | 11/2004 | Maher | |
| 6,869,162 | B2 | 3/2005 | Maher | |
| 6,890,056 | B2 | 5/2005 | Johnson et al. | |
| 7,278,699 | B2 * | 10/2007 | Drake et al. | 347/13 |
| 7,407,256 | B2 * | 8/2008 | Han | 347/19 |
| 2004/0080564 | A1 | 4/2004 | Maher | |
| 2004/0189736 | A1 | 9/2004 | Maher | |
| 2005/0057602 | A1 | 3/2005 | Okamoto | |
| 2006/0071957 | A1 | 4/2006 | Shang et al. | |
| 2006/0092204 | A1 | 5/2006 | White et al. | |
| 2006/0092218 | A1 | 5/2006 | White et al. | |
| 2006/0093751 | A1 | 5/2006 | White et al. | |
| 2006/0159843 | A1 | 7/2006 | Sze et al. | |

(Continued)

FOREIGN PATENT DOCUMENTS

| | | |
|---|---|---|
| EP | 1413442 | 4/2004 |

(Continued)

OTHER PUBLICATIONS

International Search Report for International Appl. No. PCT/IL07/01468 Date of Mailing Jul. 2, 2008.

*Primary Examiner*—Shih-wen Hsieh
(74) *Attorney, Agent, or Firm*—Pearl Cohen Zedek Latzer, LLP

(57) ABSTRACT

Embodiments of the invention are directed to a deposition printing system which includes two or more print units capable of moving with respect to each other during printing, each of the print units having one or more print heads together forming a head arrangement; and a controller to control movement of the print units to dynamically change the head arrangement during the printing.

21 Claims, 12 Drawing Sheets

U.S. PATENT DOCUMENTS

| | | | |
|---|---|---|---|
| 2006/0185587 | A1 | 8/2006 | Shang et al. |
| 2007/0024664 | A1 | 2/2007 | Shang et al. |
| 2007/0042113 | A1 | 2/2007 | Ji et al. |
| 2007/0070640 | A1 | 3/2007 | Sexton |

FOREIGN PATENT DOCUMENTS

| | | | |
|---|---|---|---|
| EP | 1 462 264 | A1 * | 9/2004 |
| EP | 1462257 | | 9/2004 |
| JP | 2004-351677 | | 12/2004 |
| WO | WO 2006/052828 | | 5/2006 |
| WO | WO 2006/078702 | | 7/2006 |
| WO | WO 2007/002660 | | 1/2007 |
| WO | WO 2007/040970 | | 4/2007 |
| WO | WO 2007/041229 | | 4/2007 |

* cited by examiner

INKJET PRINTING SYSTEM WITH MOVABLE PRINT HEADS AND METHODS THEREOF

CROSS REFERENCE TO RELATED APPLICATIONS

The present application is a Continuation-in-part Application of PCT International Application No. PCT/IL2007/001468, entitled Inkjet Printing System With Movable Print Heads And Methods Thereof, filed on Nov. 28, 2007 which in turn claims priority from U.S. Provisional Application No. 60/867,423, entitled Configurable Drop-On-Demand Printing System, filed on Nov. 28, 2006, both of which are incorporated herein by reference in their entirety.

FIELD OF THE INVENTION

The present invention relates to printing generally and to drop on demand (DOD) inkjet printing in particular.

BACKGROUND OF THE INVENTION

Deposition printing, such as for example Drop on demand (DOD) inkjet printing or aerosol printing, is known in the art. Such printing may be typically used for low speed, low volume print jobs, such as, for example, large format digital printing for the signage market, and low quantity printing of textiles.

Reference is now made to FIGS. 1 and 2 which together illustrate a prior art one pass in-line printer system 100. System 100 comprises a conveyor 120 on which print media 10 is placed, static jetting arrays 140 which drop ink onto print media 10 and a jetting controller 150 which indicates to jetting arrays 140 when and how to print to produce a printed image 115 as per input image data 155.

One or more jetting arrays 140 may be used to print each color that may be used by a print job. One or more additional jetting arrays 140 may also be dedicated to the application of additional coatings or varnishes as required. As illustrated in FIG. 2, a jetting array 140 is organized into print units 160. The print units are static with respect to each other. Each print unit 160 consists of one or more print heads 170, and each print head 170 may have several dozen or even hundreds of nozzles 180, although for the sake of clarity, only a few are shown in FIG. 2. Multiple print heads 170 may be used together to speed up the print process and/or to print-images of varying degrees of resolution.

Jetting controller 150 (FIG. 1) transmits a stream of commands to jetting arrays 140 that control the jetting of nozzles 180 in order to translate image data 155 to printed image 115. As print media 10 passes underneath jetting arrays 140, jetting arrays 140 may remain in a static position and nozzles 180 can then jet onto print media 10. Each nozzle 180 may jet thousands of drops per second during the printing process.

Nozzles 180 may suffer defects that may partially or wholly impair their effectiveness. Such nozzles may stop jetting or may jet poorly. Such defects may be of either a temporary, or a permanent nature.

DOD inkjet systems and other deposition printing systems, such as aerosol jetting printing system or a dispenser, may therefore require frequent maintenance to prevent or repair such defects, and to ensure the ongoing reliability of the dispensing heads. Such maintenance may include, for example, in the case of inkjet, purging the nozzles with liquid or air, wiping and/or brushing the nozzles and/or the orifice plate, fire jetting with the entire group of nozzles or part of them, heating or cooling the nozzles, or washing the heads with liquids. Nozzles with permanent defects may be replaced.

Typically, such maintenance may be performed several times during a printing hour. Repeated stoppage of the printing process to perform maintenance may slow down the printing process and consequently raise the cost of printing. Conversely, failure to perform timely maintenance of the nozzles may result in poorer print quality and higher equipment costs as a higher percentage of nozzles may be permanently damaged and may need to be replaced.

The most common implementation of DOD inkjets for printing applications, such as graphic arts and others, entails multiple passes over the same area. The jetting heads pass over the same area a number of times, each time with a small shift so that each nozzle jets in several slightly different locations. The resulting print area for a given nozzle may therefore be overlapped by the print area for one or more other nozzles. Since the same area is printed by more than one nozzle, these overlapping print areas may serve to mitigate the effects of a defective nozzle that jets poorly or not at all. Accordingly, the use of such multiple pass jetting with overlapping print areas may enable a system to create quality prints even with several defective nozzles. It is highly desired to have a one pass jetting system capable of compensating for defective nozzles to enable creating quality prints.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
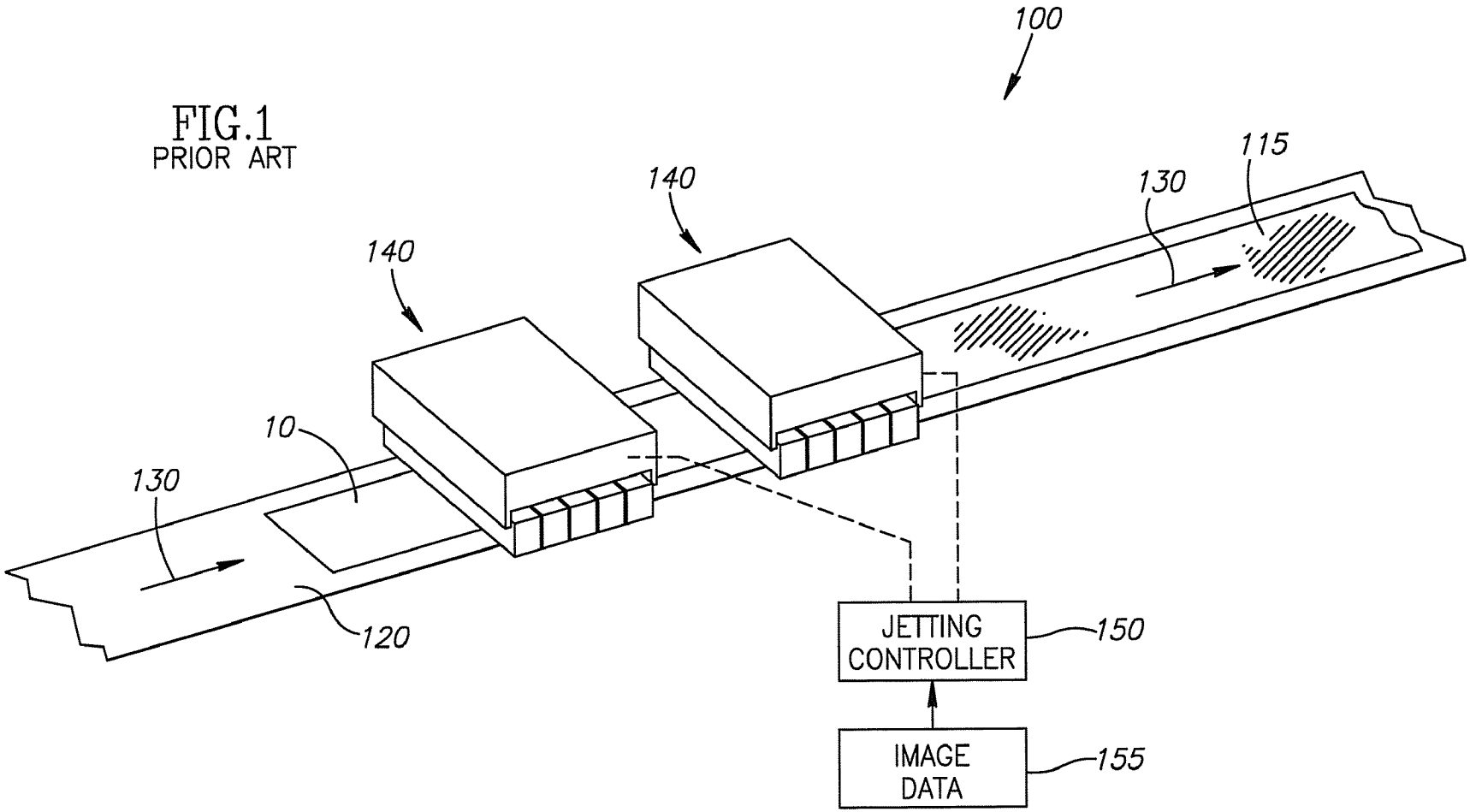
FIG.1 PRIOR ART
FIGS. 1 and 2 together are a schematic illustration of a prior art one pass in-line printer system 100.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like.

Some embodiments of the invention are directed to a deposition printing system that includes two or more print units capable of moving with respect to each other during printing. In the description below a demonstrative embodiment of an inkjet printing system is illustrated. It should be, however, understood to a person skill in the art that embodiments of the invention are not limited in this respect and other suitable deposition printing systems may be used, such as, an aerosol printing system, a dispenser and others.

Figure 3:
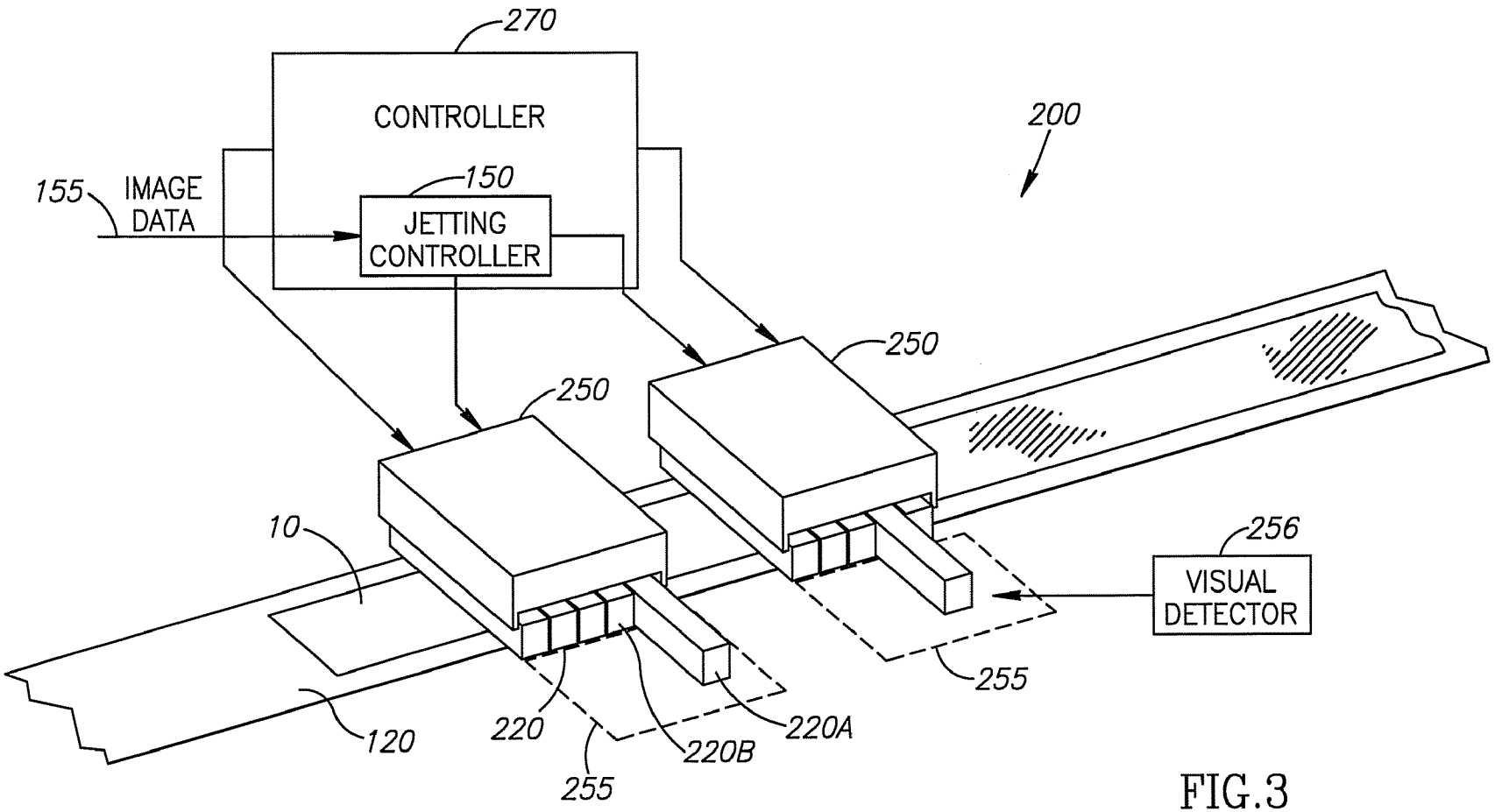
FIGS. 3 and 4 together are a schematic illustration of an exemplary printing system according to embodiments of the present invention.
Figure 4:
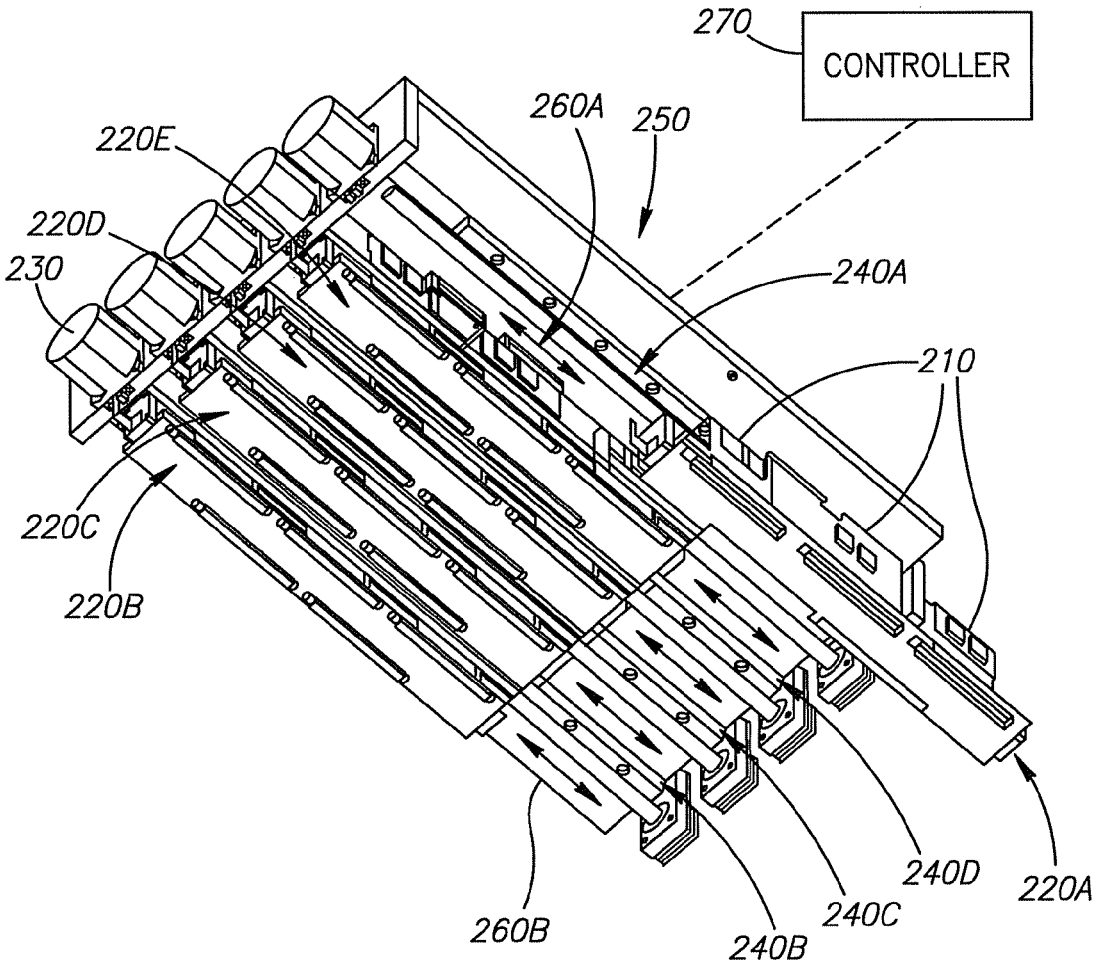

Reference is now made to FIGS. 3 and 4, which together illustrate an exemplary inkjet printing system 200 according to embodiments of the invention. System 200 is capable of executing continuous high speed, high volume print jobs without frequently stopping for maintenance. Similar reference numerals refer to similar units.

Printing system 200 may include conveyor 120, defining the width of a print area, on which print media 10 is placed, one or more jetting array housings 250 laterally positioned in fixed positions facing conveyor 120, a controller 270 to control the printing process and one or more maintenance stations 255. Each housing 250 may have a designated maintenance station 255 that may be set in close proximity to its associated jetting array alongside conveyer 120. Printing system 200 may further include a visual detector 256, such as camera or charge coupled device (CCD) coupled to controller 270 and positioned in proximity to maintenance station 255 to inspect the status and condition of nozzles of print units located at the maintenance area. Any other suitable visual detector capable of inspecting the nozzles may be used.

Printing system 200 may include, attached to each jetting array housing, two or more movable print units 220 capable of moving with respect to each other during printing. Print heads 220 may move in a direction substantially perpendicular to the print direction represented by the direction of advance of conveyer 120. Each of the print units may include one or more print heads located in fixed positions within the movable print unit. The relative positioning of the print units with respect to each other form particular head arrangement capable of being dynamically changed during printing (on the fly).

For a given head arrangement, the desired functionality of each of print units 220 may be determined by controller 270. For example, print unit 220A may be designated as an idle print unit to indicate that the print unit temporarily does not actively jet participate and can move to the maintenance area. The remaining print units, 220B-220E may be designated as active print units to indicate that they are currently involved in printing, namely, at least one of their nozzles may jet according to the image data. According to embodiments of the invention, one or more of print units, for example unit 220D may be designated as compensating print unit having the role of compensating for defect nozzles belonging to at least another print unit, for example 220C. Therefore, both print units 220D and 220C print wherein print unit 220C jets from its nozzles according to the image data excluding the defective nozzles and print unit 220D jets only from nozzles that may replace the defective nozzles of print unit 220D.

Although print units 220A-220D are described as associated with an inkjet printing system, it should be, however, understood to a person skilled in the art that embodiments of the invention are not limited in this respect and the print units according to other embodiments of the invention may be associated with other suitable deposition printing systems, such as an aerosol printing system or a dispenser.

It should be understood to a person skilled in the art that, over time, each print unit 220 may be designated as either "active", "idle" or "compensating", according to its current functionality. According to embodiments of the invention, the timing of the role changing of the print units is determined so as to maintain substantially even distribution of workload between the print units. Further, according to embodiments of the invention, in order to maintain substantially even distribution of workload between nozzles within one print unit, the print unit may be moved, from time to time, with respect to other print units to enable activation of previously inactive nozzles.

According to an exemplary embodiment of the invention, each print unit 220 may include four print heads, each having 192 nozzles. It should be understood however to a person skilled in the art that the invention is not limited to such an arrangement and according to embodiments of the invention, any suitable numbers of print heads and nozzles are applicable.

Controller 270 may dictate the movement of various movable print units 220, with respect to each other, within and without the print area, to their associated maintenance stations. Controller 270 may control movement of the print units to dynamically change the head arrangement during the printing.

In accordance with embodiments of the present invention, controller 270 may track the maintenance schedule of movable print units 220. When a movable print unit, here labeled 220A, requires maintenance, controller 270 may determine the current status functionality of the unit to be idle and instruct a motor unit 230 coupled to print unit 220A to move to its maintenance station 255. Since maintenance stations 255 are generally located alongside conveyor 120, printing system 200 may continue to print while movable print unit 220A undergoes maintenance.

As illustrated in FIG. 4, movable print units 220 are located in jetting array housing 230 and may be moved along sliders 240. Such movement may extend most of each movable print unit 220 beyond the extent of jetting array housing 230 to maintenance station 255. It will be appreciated that maintenance stations 255 are located outside of a print area as defined by the area underneath "active" movable print units 220.

Figure 5:
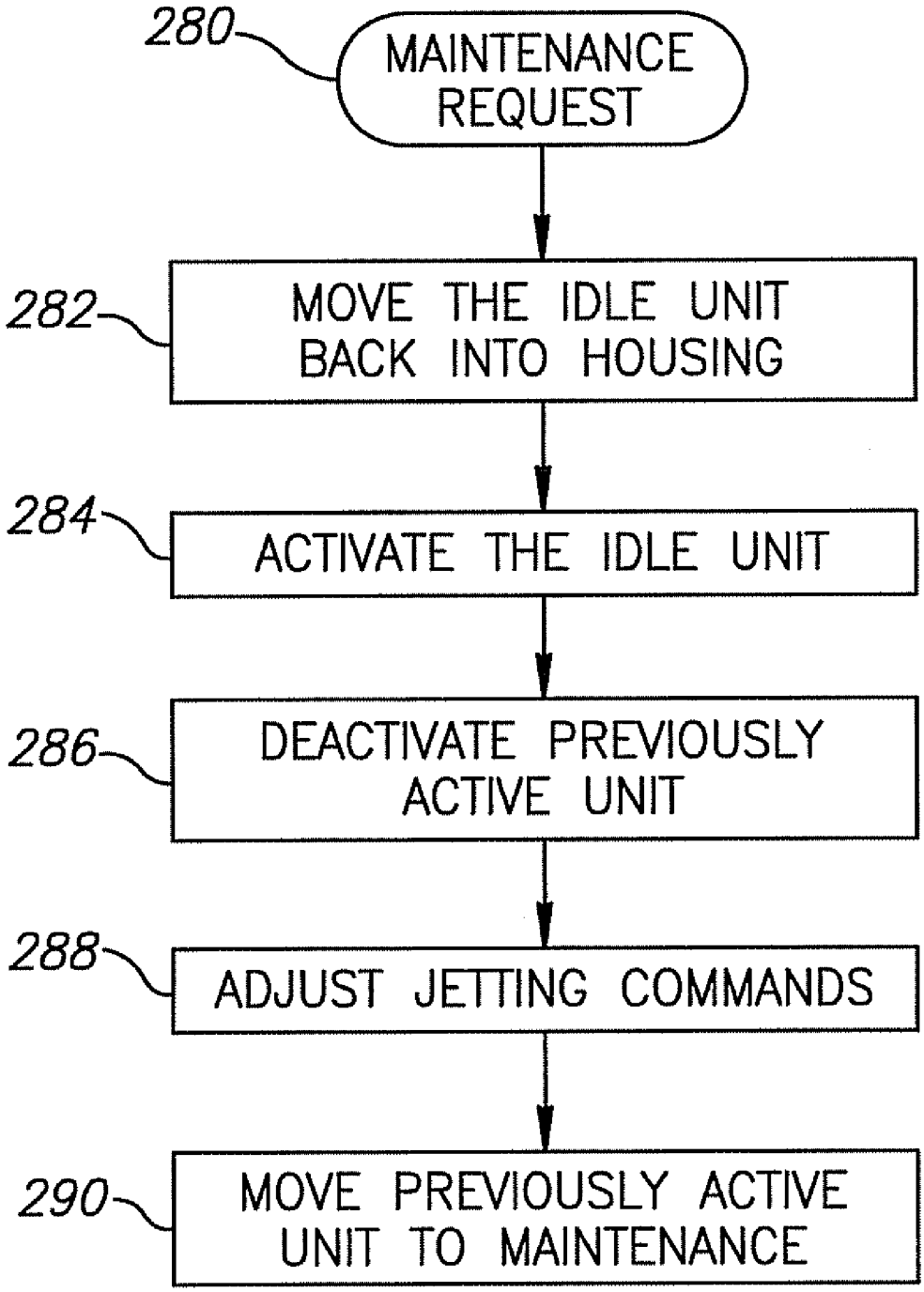
FIG. 5 is a flow chart illustration of an operating method according to embodiments of the present invention.

Reference is now made to FIG. 5 which illustrates a method according to embodiments of the invention by which system 200 may perform maintenance while continuing to print. As shown in FIG. 5, when, for example, movable print unit 220B requires maintenance (step 280), controller 270 may issue (step 282) a command to another movable unit 220A, which may be idle at the time, to slide back into jetting array housing 230. Controller 270 may then designate movable print unit 220A as active (step 284) and movable print unit 220B may then be designated the idle print unit (step 286) and, may then adjust the jetting commands (step 288) based on the change in status of movable print units 220A and 220B. The jetting commands are adjusted due to the fact that the physical location of movable print unit 220A differs from the physical location occupied by movable print unit 220B. Controller 270 may then wait for a cycle where movable print unit 220B may not be in actual use before issuing (step 290) a command to movable print unit 220B to move along slider 240B (arrow 260B) to maintenance station 255.

While in maintenance station 255, print heads 210 in movable print unit 220 may undergo various maintenance procedures including, for example, purging the nozzles with liquid or air, wiping and/or brushing the nozzles and/or the orifice plate, fire jetting with the entire group of nozzles or part of them, heating or cooling the nozzles, or washing the heads with liquids. Nozzles with permanent defects may also be replaced. The print unit may be inspected prior to performing the maintenance operations using manual inspection or automatic inspection using detector 256. According to embodiments of the invention, based on the inspection result, it may be determined if the print unit require maintenance and if so what maintenance operations to perform.

After maintenance is completed, movable print unit 220 may be examined. This examination may be an automated procedure using detector 256 and/or may employ a manual operator. The examination may also include a visual inspection of the movable print unit 220 and print heads 210. A test print may be performed and the measurement of the resulting drop shapes and weights may be checked using either manual procedures or automated test equipment. Various characteristics of movable print unit 220 may also be measured, including, for example, temperature, electronic pulses and/or pulse shapes. The registration and alignment of print heads 210 may also be measured.

The examination results may then be analyzed to detect, for example, missing nozzles, weak nozzles, crooked nozzles, a drop volume that is not proper, and/or misalignment of print heads 210. Depending on the errors detected, another maintenance session may be required, one or more print heads 210 may be replaced, and/or printing may continue with movable print unit 220. It may be possible to compensate for some defects by using jetting controller 150 to adjust the printing parameters for the affected print head 210. Such parameters may include, for example, jetting pulse, shape, amplitude and/or temperature.

After analysis of the examination results and adjustment of any parameters as needed, the idle movable print unit 220 may then be available to replace another movable print unit 220 due for maintenance.

It will be appreciated that there may be more than one idle movable print unit 220 in a given head arrangement. The number of "idle" and "active" movable print units 220 may be configured in accordance with an operator's requirements for speed, resolution, and frequency of maintenance.

Figure 6A:
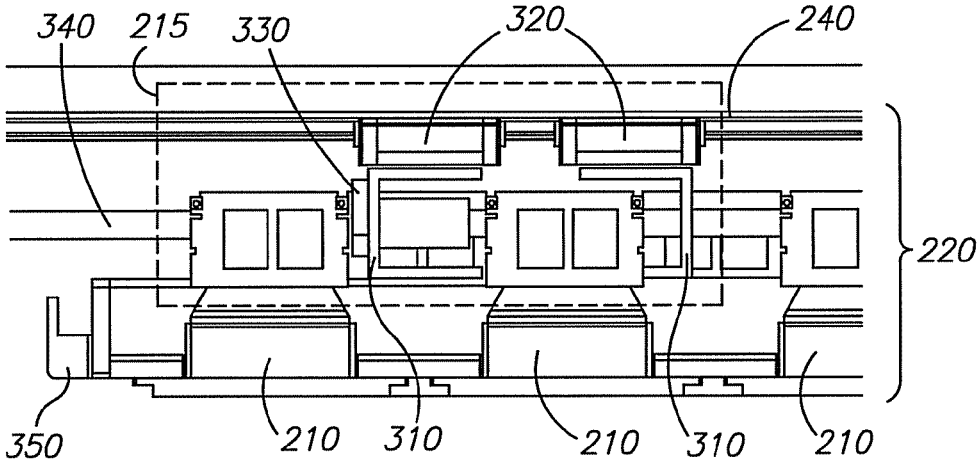
FIG. 6A is a cross-sectional view of movable print unit according to exemplary embodiments the present invention.

Reference is now made to FIG. 6A which is a cross-sectional view of one movable print unit 220. Movable print unit 220 may comprise print heads 210, a translation apparatus 215 and slider 240. Translation apparatus 215 may comprise connecting brackets 310, slider guide carriages 320, a lead screw driving nut 330, and a lead screw 340.

Slider guide carriages 320 may straddle slider 240, and movable print unit 220 may be connected to slider guide carriages 320 via connecting brackets 310. Lead screw driving nut 330 may also be affixed to movable print unit 220 via connecting brackets 310. Lead screw 340 may run through lead screw driving nut 330 such that, when lead screw 340 turns, movable print unit 220 may move along slider 240.

Figure 6B:
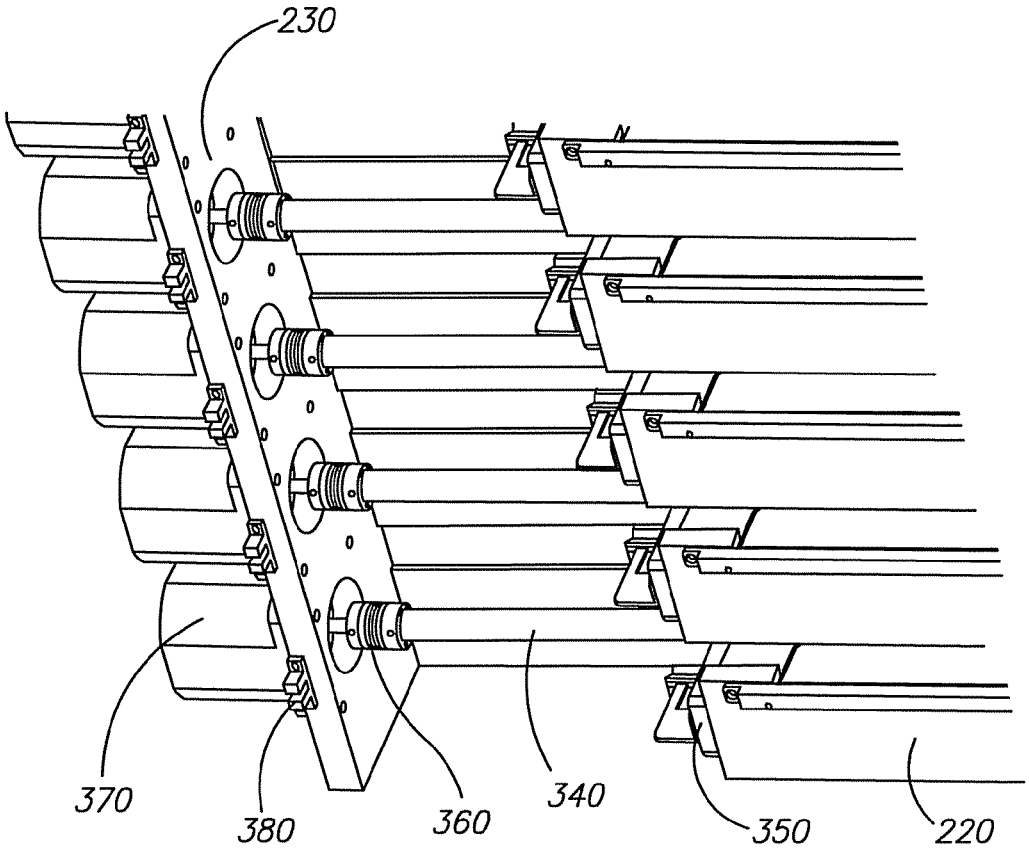
FIG. 6B is a schematic illustration of a close-up view of a portion of an exemplary printing system according to embodiments of the present invention.

Reference is now made to FIG. 6B, which illustrates a close-up view of portion of a printing system, the "home position area", according to embodiments of the present invention. The home position area may include, for example, lead screws 340, home flags 350 (attached to movable print units 220), couplings 360, stepper motors 370, home position sensors 380 and configurable jetting array housing 230.

Home flags 350 may be used to determine whether or not movable print units 220 may be in their home position. As such, home position sensors 380 may be mounted on jetting array housing 230, opposite home flags 350 which are attached to the end of movable print units 220. When, for example, system 200 is powered up, movable print units 220 may be moved to a home position, such that home flag 350 may be sensed by home position sensor 380. Home position sensors 380 may be, for example, optical or electrical proximity sensors.

Controller 270 may then register each movable print unit 220 as being in the home position. When movable print unit 220 may be designated for movement, for example to the maintenance area, stepper motor 370 may be used to turn lead screw 340. Controller 270 may then track the new position of print units 220 by calculating the offset defined by the difference between the home position and the movement generated by stepper motor 370.

According to embodiments of the invention, the positions of the print unit, both the initial positions relative to each other and the changes in the positions of the units in the print area during printing may be determined by performing an optimization calculation. The optimization calculation may be stochastic calculation based on image data and/or nozzle status data. For example, based on the knowledge that a particular nozzle of a particular print unit is defective and that a portion of the image is blank, the optimization calculation may assign the print head having the most defective nozzles to be positioned above the area that is not to be printed.

It will be appreciated that as described herein above, printing system 200 may provide continuous DOD one pass printing without frequent stoppages for maintenance.

In an alternate embodiment of the present invention, printing system 200 may not be configured for one pass printing. For example, printing system 200 may be configured for web printing or multiple pass printing.

Applicants have realized that movable print units 220 may be configured to increase the speed of a print job or alternatively to increase the resolution by multiple-layer printing. Accordingly, in some embodiments of the present invention, printing system 200 may be configured to print with higher speeds.

Figure 8:
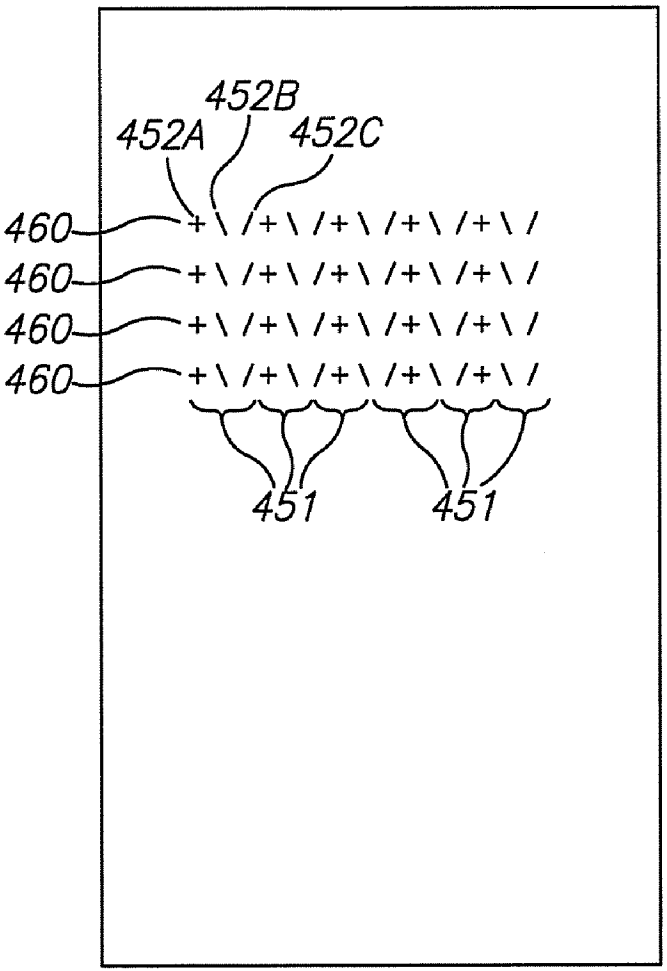
FIGS. 8, 9B, 10B, and 11B are magnified views of exemplary printouts from the print units of FIGS. 7, 9A, 10A and 11A, respectively.
Figure 7:
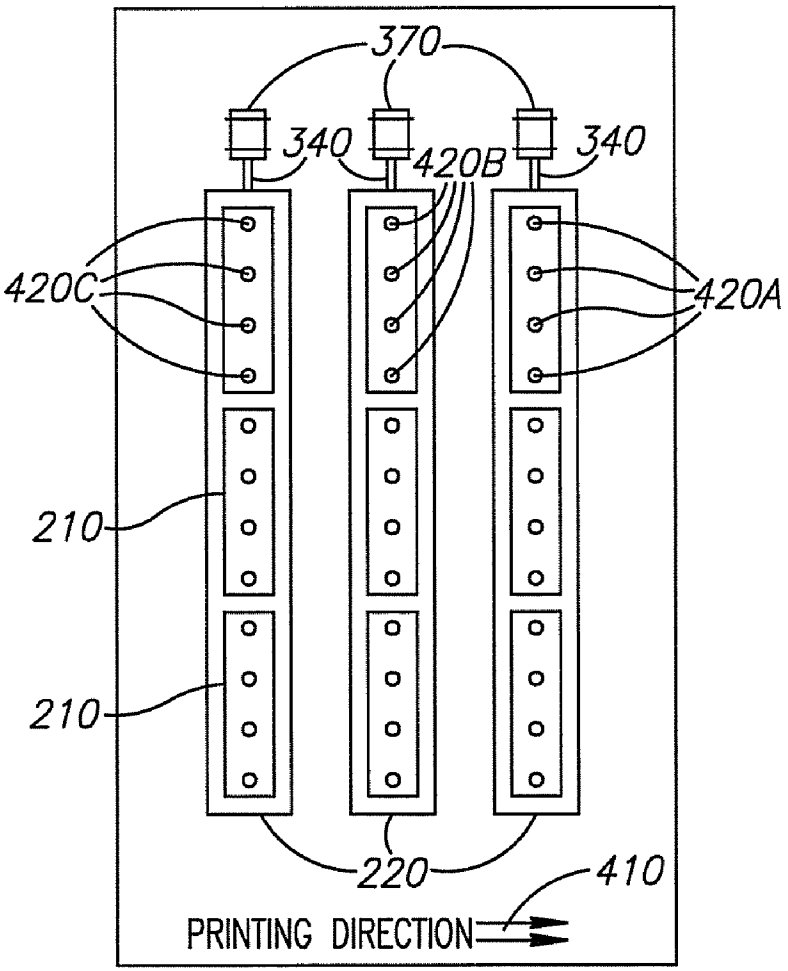
FIGS. 7, 9A, 10A, and 11A are schematic illustrations of different states of movable print units according to embodiments of the invention.

Reference is now made to FIG. 7, which illustrates the active movable print units 220 in an exemplary print head arrangement. Each print head 210 may have several dozen or even hundreds of nozzles 420, although for the sake of clarity, only a few are shown in FIG. 7. Reference is also made to FIG. 8, which illustrates a magnified view of an exemplary printout from such a print head arrangement. FIG. 7 also shows stepper motors 370 and lead screws 340 which may control the movement of movable print units 220. As in the previous embodiments, similar reference numerals refer to similar units.

It will be appreciated that all movable print units 220 in FIG. 7 may be configured in precise alignment, such that they may occupy parallel positions along the same print axis when printing in a printing direction 410. In FIG. 8, output lines 460 represent the combined print output from nozzles 420. Output from nozzles 420A is represented as "/"; output from nozzles 420B is represented as "\"; and output from nozzles 420C is represented as "+".

Such an alignment may enable printing system 200 to print at a higher speed. Since nozzles 420A, 420B and 420C may each respectively jet over the same location, controller 270 may instruct nozzles 420 to print simultaneously in mutually exclusive contiguous print areas using interlacing printing.

FIG. 8 illustrates the results of such instruction. Each print line 460 comprises a repeating pattern of output 451 from nozzles 420A, 420B, and 420C. Each respective pattern of output 451 is comprised of three nozzle outputs 452, representing the output from nozzles 420A, 420B and 420C. It will be appreciated that since nozzles 420A, 420B and 420C may print simultaneously, the time required to print each respective pattern of output 451 may be equal to the time required for each respective nozzle 420. Accordingly, it will be appreciated that in such a configuration printing system 200 may print at a speed which is three times as fast.

It will further be appreciated, that such an alignment where each line is printed by several different nozzles, may improve print quality and result in better image quality As each line of output may be printed by a multiplicity of nozzles 420, the effect of a given missing or defective nozzle 420 may be less noticeable since other nozzles 420 may also be printing on the same line.

It will further be appreciated, that such an alignment where each line is printed by several different nozzles may increase print resolution and material per dot throughput and may enable multiple-layer printing. According to some embodiments of the invention, controller 270 may instruct nozzles 420A, 420B and 420C to jet consecutively over the same location so as to increase the amount of material per dot by three.

Figure 2:
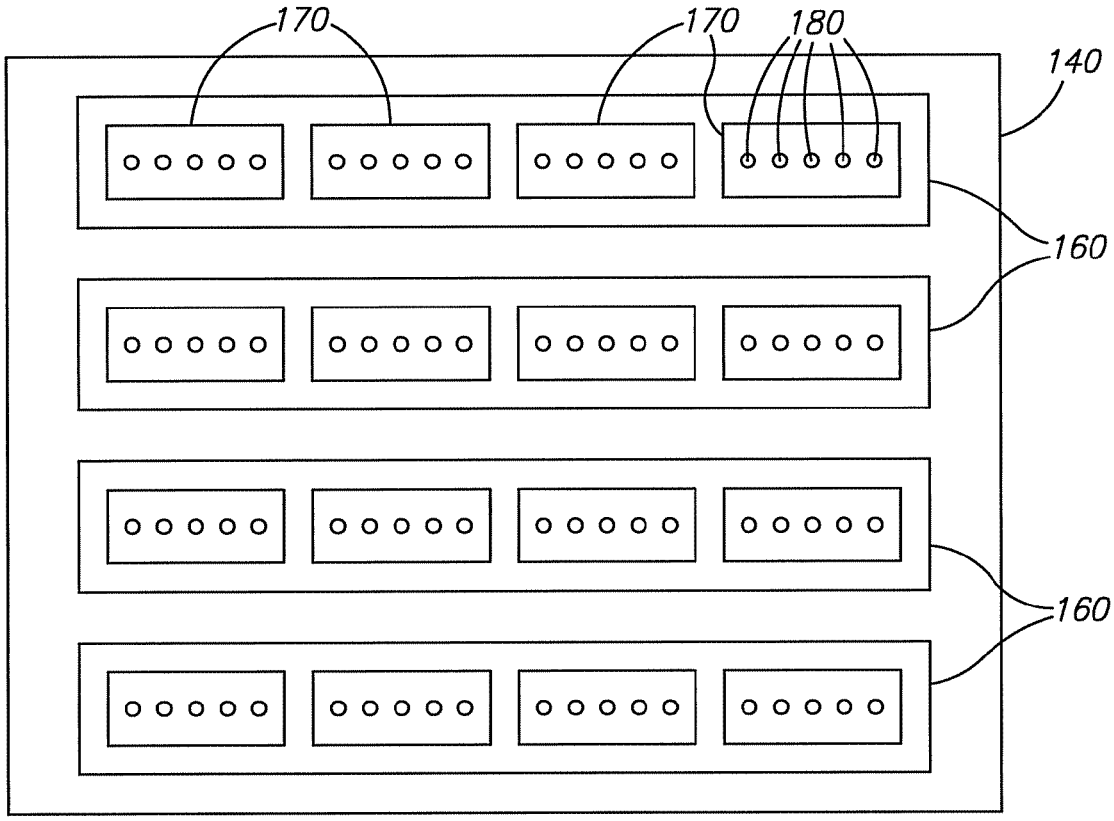
FIG.2 PRIOR ART

In a typical DOD printing system (such as in FIGS. 1 and 2), it is not uncommon that the nozzles on a given print head may print in slightly different strengths. This may be caused by a combination of circumstances, including, for example, the distance from the ink source to a nozzle; temperature variances within the print head; dust and impurities in the print head; and defects caused by extended use. It will be appreciated that such differences may also exist when comparing the relative strength of nozzle output from different print heads and movable print units 220.

It will therefore be appreciated that the exemplary print out illustrated in FIG. 8 may not be of a uniform and consistent strength. For many print jobs this level of print quality may be acceptable. However, there may be print jobs, for example when printing a uniform color background when a more homogeneous output is required. According to embodiments of the present invention, controller 270 may finely adjust the location of movable print units 220 within jetting array housing 230 to enable a homogeneous coverage of the print area for a desired resolution.

Figure 9B:
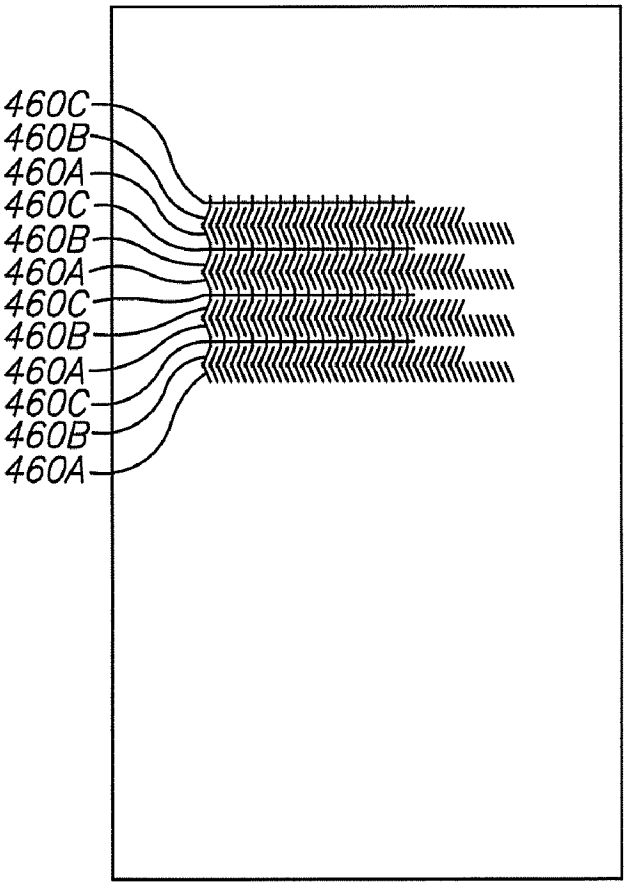
Figure 9A:
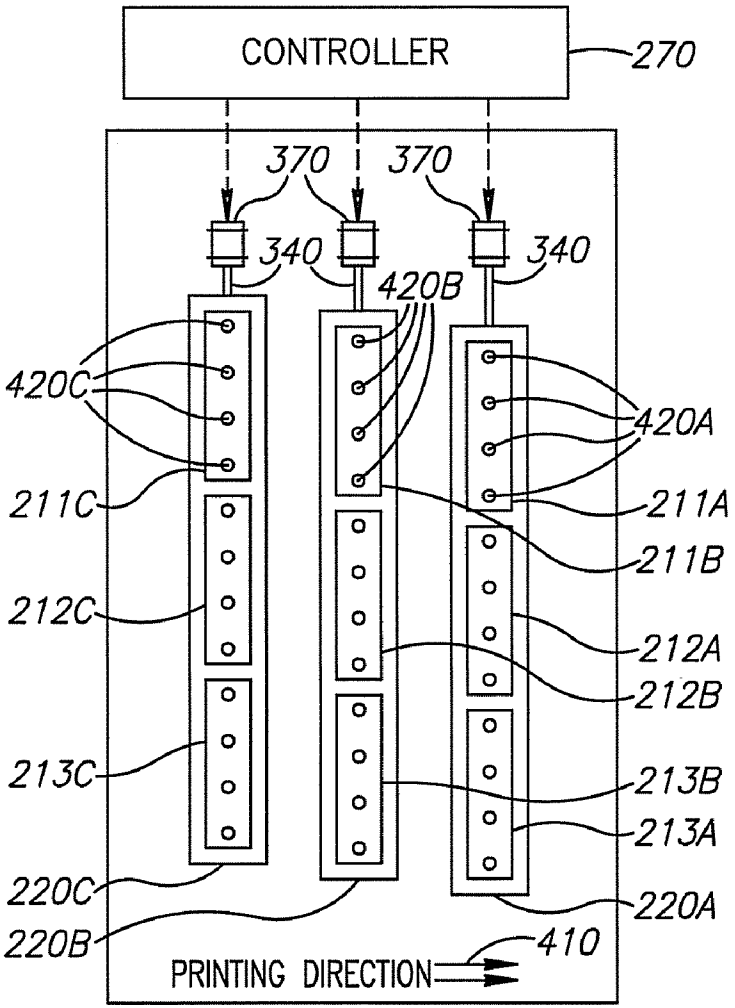

Reference is now made to FIG. 9A which shows an exemplary head arrangement configured according to embodiments of the invention in such a manner as to provide a more complete and homogeneous coverage of the print area. Movable print units 220A, 220B and 220C may each include three print heads 211, 212 and 213. Reference is also made to FIG. 9B which represents an exemplary printed output from such an head arrangement. Similar reference numerals refer to similar units.

It may be unlikely that that all nozzles 420 have the same jetting strength. For example, nozzles 420A on movable print unit 220A may generally jet more weakly than nozzles 420B on movable print unit 220B, or print heads 212 may generally jet more weakly than print heads 211 and 213. There may even be variances of jetting strength among the different nozzles 420 in the same print head 211, 212 or 213. Controller 270 may use data regarding the relative strengths of nozzles 420 to determine a homogenized print head arrangement for movable print units 220. The homogenized print head arrangement may be determined by stochastic optimization calculations. The data may be delivered to controller 270 from visual detector 256 or from other sources.

Based on such homogenized print configuration, controller 270 may instruct stepper motors 370 to move print units 220 within the print area. As in the previous embodiments, motors 370, for example stepper motors, may move movable print units 220 by turning lead screws 340. However, according to embodiments of the present invention, such movement may be in very small increments. In such a manner, the active movable print units 220 may be staggered slightly in generally equidistant increments over the print area. Accordingly, when printing in printing direction 410, the nozzles 420 for each print unit 220 may not be aligned along identical print axes with the associated nozzles 420 of the other print units 220.

As shown in FIG. 9B, print lines 460A, 460B, 460C may now each be located on slightly different print axes, such that there may now be three times as many effective print lines 460 when compared, for example, to the previous embodiment of FIG. 8. It will be appreciated that, depending on the number and density of nozzles 420, the effective print axes may now be contiguous or even overlapping, such that a given print area will typically be covered by multiple nozzles 420 from more than one movable unit 220. Furthermore, such print areas may now be covered by nozzles 420 from multiple print heads 211, 212 and 213 with varying jetting strengths. Accordingly, it will be appreciated that for a given combination of print conditions, the overall coverage of the print area may be more homogenous when movable print units are staggered over the print area.

According to embodiments of the present invention, the print head arrangement may be adjusted to compensate for missing or defective nozzles 420.

As described hereinabove, after movable print units 220 undergo maintenance, they may then be examined and/or tested to detect persistent defects that may not have been remedied by the maintenance session. It is expected that some nozzles 420 may have such persistent defects after maintenance is performed. In such cases, movable print units 220 may be submitted for another maintenance session, or may have some of its component parts replaced. It is also possible that the entire movable print unit may need to be replaced. According to embodiments of the invention, detector may send an alert to controller 270 notifying that a replacement of one or more print heads is needed. It may also be expected that some movable print units 220, with relatively few missing or defective nozzles 420, may be returned to "active" status even though their use may affect the quality of the print job.

According to embodiments of the present invention, one of print units 220 may be designated as a replacement unit (U) or compensating unit for missing and/or defective nozzles 420 of another print unit 220. If one or more nozzles 420 are detected as missing or defective in a movable print unit 220, RU may be moved and located in position to provide jetting action in place of the missing and/or defective nozzles 420.

Figure 10B:
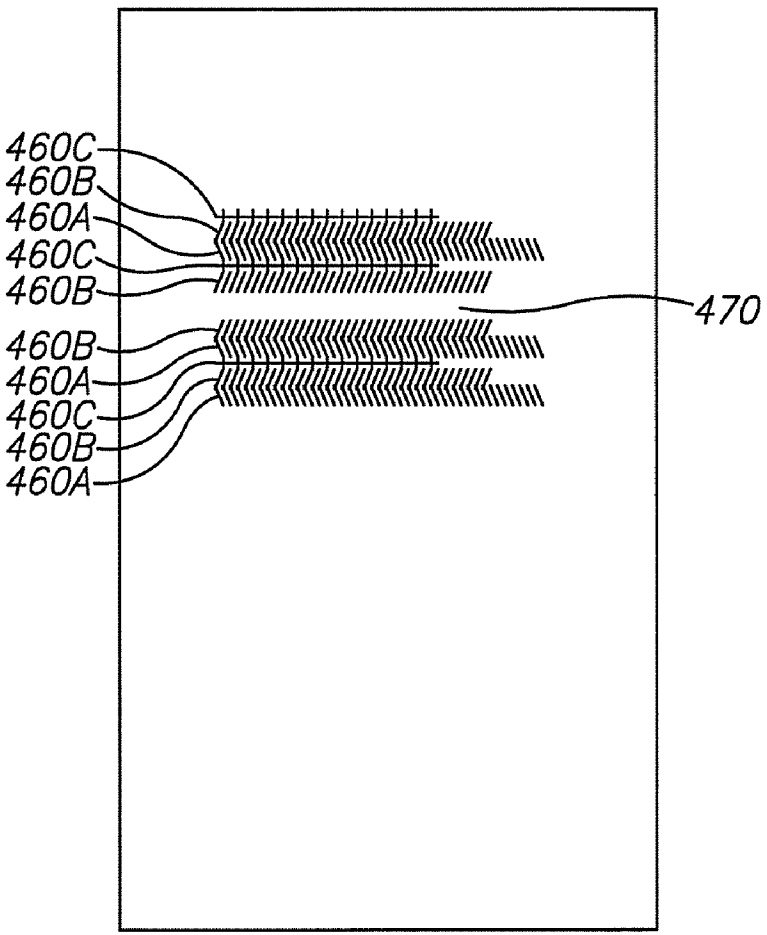
Figure 10A:
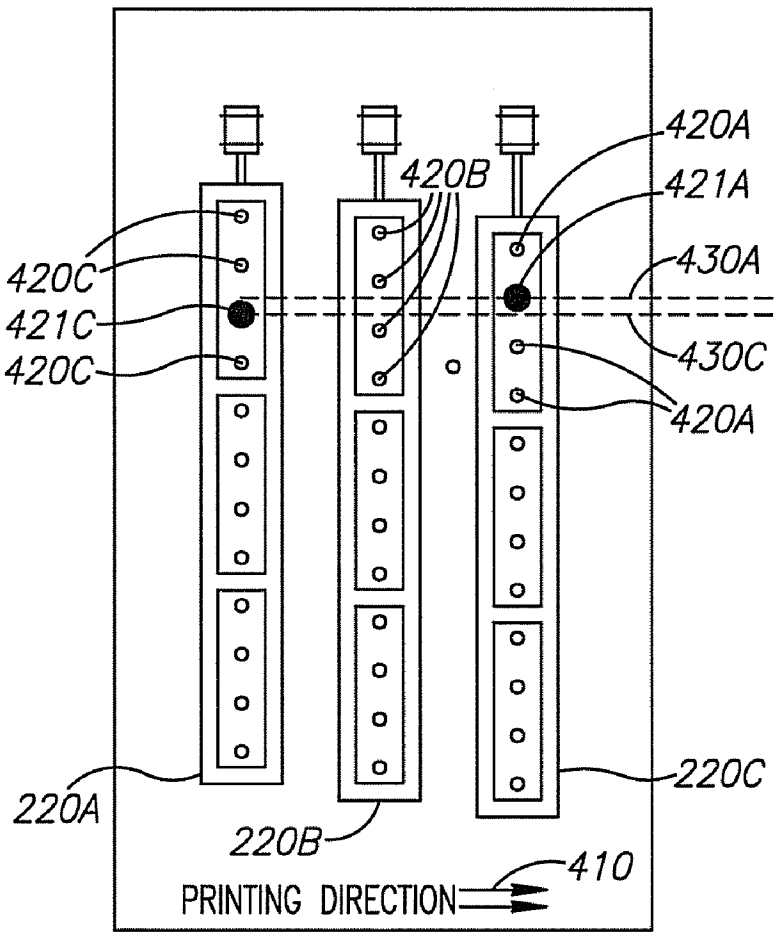

FIGS. 10A and 10B, to which reference is now made, together illustrate possible effects of a given alignment of movable print units 220 on the quality of output lines 460. Movable print units 220 may have a number of defective nozzles 421 that may have been identified in a previous maintenance session. For example, defective nozzle 421A may be located on movable print unit 220A, and defective nozzle 421C may be located on movable print unit 220C. Print axes 430A and 430C may represent the print path of nozzles 421A and 421C when printing in a print direction 410. Similar reference numerals refer to similar units.

As shown in FIG. 10A, the location of defective nozzle 421A may dictate a print axis 430A, and the location of defective nozzle 421C may dictate a print axis 430C. Accordingly, while defective nozzles 421A and 421C may be located on different movable print units 220, they may be assigned to jet on contiguous or overlapping print axes. FIG. 10B shows the results of such printing. A noticeable gap 470 appears among the lines of printed output 460 where defective nozzles 421A and 421C were supposed to have jetted.

Figure 11B:
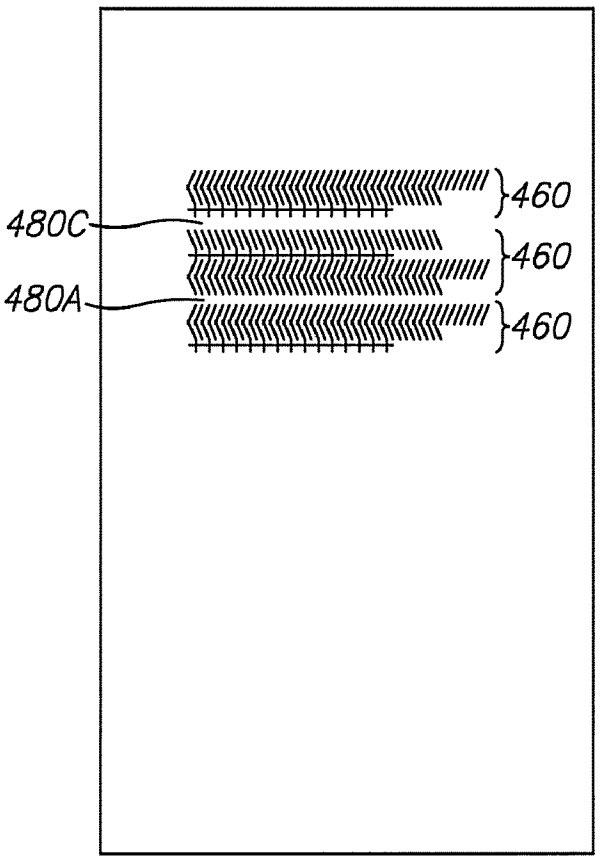
Figure 11A:
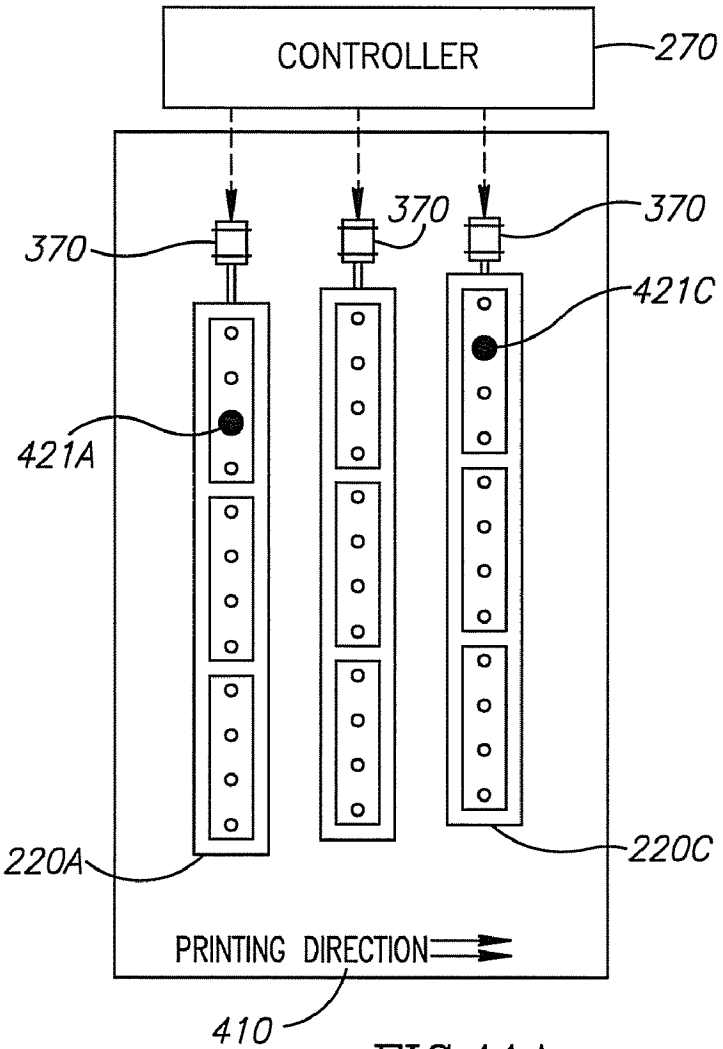

Reference is now made to FIG. 11A which shows the print units configured in a particular print head arrangement as to compensate for the existence of defective nozzles 421A and 421C in movable print units 220A and 220C, respectively. Reference is also made to FIG. 11B which represents an exemplary printed output from such a print head arrangement. Gaps 480A and 480C appear among printed lines 460. Similar reference numerals refer to similar units.

Controller 270 may instruct stepper motors 370 to move print unit 220C slightly in order to provide distance between the print axes 430 of defective nozzles 421A and 421C respectively. According to embodiments of the invention, controller 270 may determine the desired head arrangement based on stochastic optimization calculations taking into consideration the nozzle status data. According to some embodiments, the optimization calculation may further be based on the specific image data. It will be appreciated that other print units 220, for example unit 220A, may also be moved as needed.

In the resulting exemplary print head arrangement movable print unit 220C has moved to a new position, thus creating distance between the print axes 430C and 430A of defective nozzles 421C and 421A when printing along print direction 410. As shown in FIG. 11B, two smaller gaps 480C and 480A are shown among printed lines 460.

It will be appreciated that smaller gaps 480C and 480A may be less noticeable than gap 470 and may be invisible to the naked eye. It will further be appreciated, that movable print units 220 may be configured in such a manner that printed characters 460 may be on overlapping print axes. In such print head arrangements, gaps 480A and 480C may be eliminated in part or in entirety as other nozzles 420 may jet on the print area nominally covered by defective nozzles 421.

According to embodiments of the present invention, movable print units 220 may also be configured in such a manner as to more efficiently print a printed image with variable widths. This may be facilitated by extending and/or retracting movable print units 220 over a wider print area before and/or during the course of a print job.

Figure 12A:
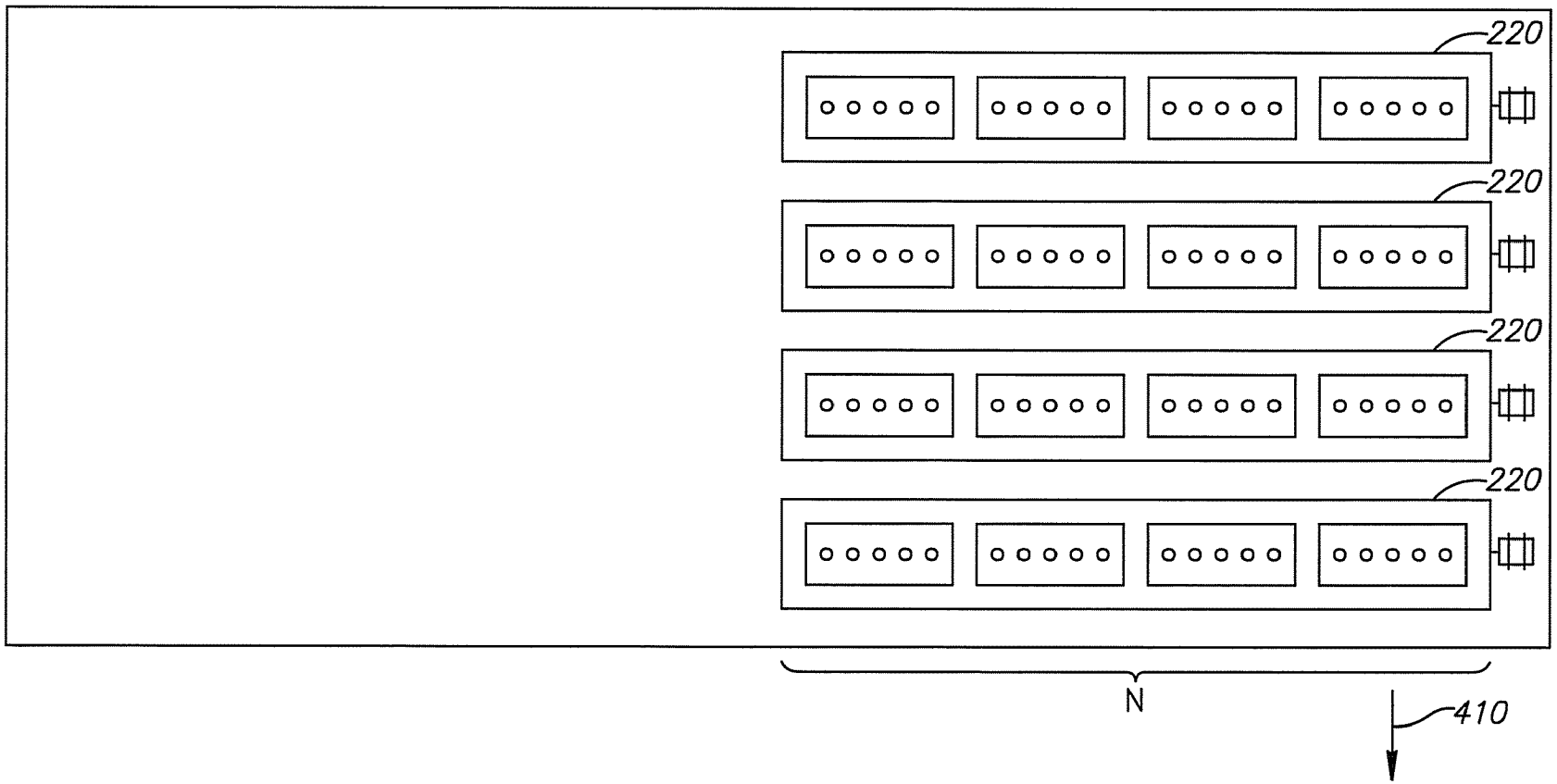
FIGS. 12A and 12B together illustrate a method of printing with variable widths during the course of a print job according to embodiments of the invention.
Figure 12B:
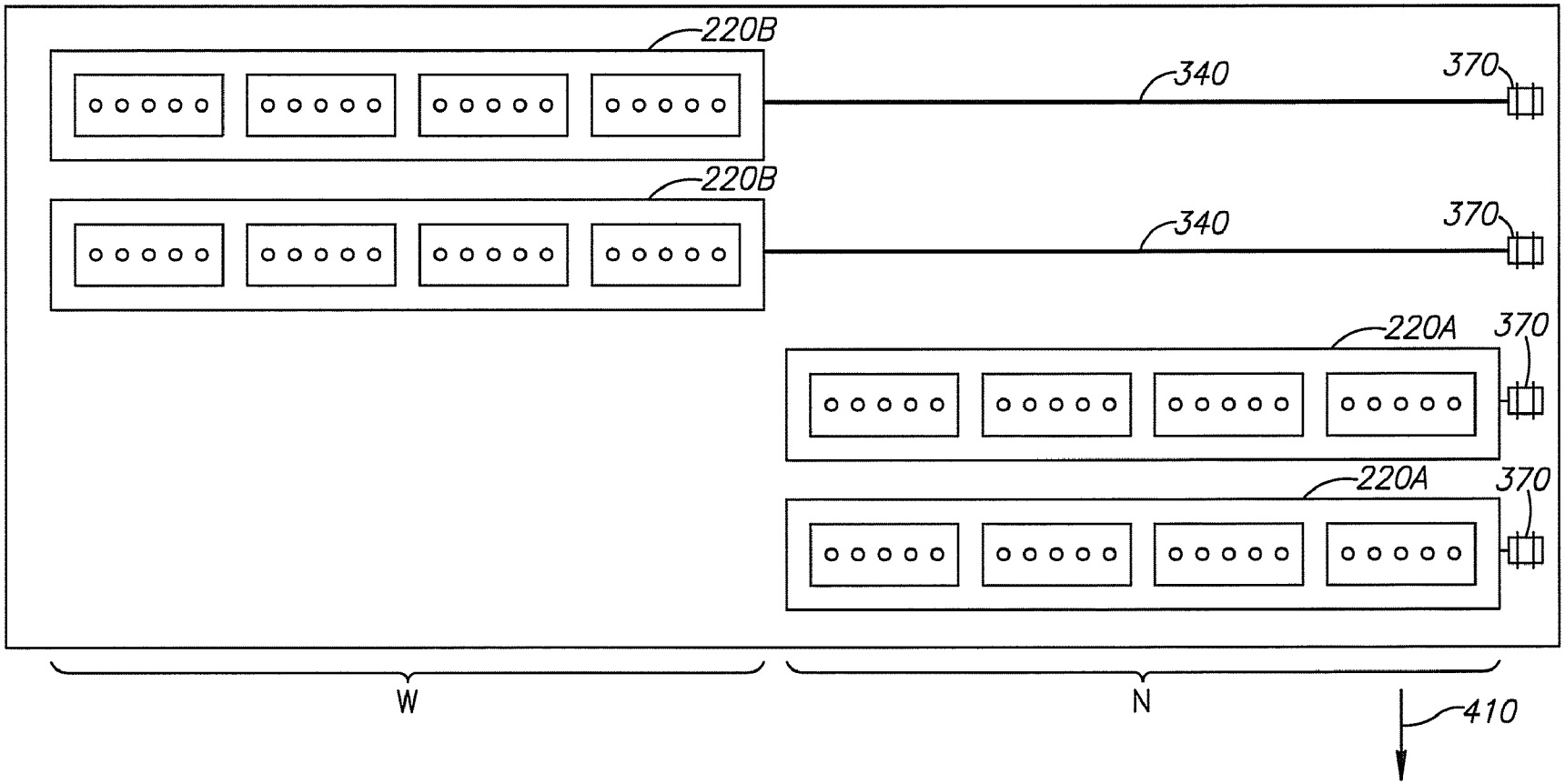

Reference is now made to FIGS. 12A and 12B which together illustrate how movable print units 220 may be moved to print with variable widths during printing. As shown in FIG. 12A, printing unit 200 may comprise a multiplicity of movable print units 220 configured in parallel to print in a narrow print area "N" in a direction 410. It will be appreciated that, as described hereinabove, such a configuration may be used, for example, to increase the speed or resolution of a print job.

However, such a configuration may not be sufficiently wide to print a wider print area. For such cases, it may be necessary to move print units 220 into a new print head arrangement as shown in FIG. 12B. Stepper motors 370 may extend lead screws 340, thus moving movable print units 220B, as required, to provide coverage for additional print area "W".

It will be appreciated that movable print units 220A may remain in place and continue printing in print area N. However, such printing may now be at a lower speed, or alternatively, the resolution may be lower.

It will also be appreciated that movable print units 220B may be retracted and returned to their original locations (as shown in FIG. 12A) for subsequent ports of the print job that do not require wider print coverage. The print speed and/or resolution may then be adjusted accordingly.

It will further be appreciated that the configurations in FIGS. 12A and 12B are exemplary. Other configurations may also be used. For example, N and W may be of different widths. Furthermore, non symmetric configurations may be used to print areas N and W with different resolutions, and staggered non parallel movable print units 220 may be used instead of the generally parallel units 220 shown in FIGS. 12A and 12B.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A deposition printing method, the method comprising:

printing from two or more print units, each of the print units having one or more print heads together forming a head arrangement;

moving during printing at least one of the print units with respect to another one of the print units to dynamically change the head arrangement;

selecting one of the print units as an idle print unit; and moving the idle print unit to a maintenance area during printing.

2. The printing method of claim 1, wherein moving during printing comprises moving one of the print units with respect to another one of the print unit while at least one nozzle of the other print unit is jetting.

3. The method of claim 1, comprising:

performing an optimization calculation based at least on image data;

selecting a desired head arrangement based on the calculation; and moving at least one of the print units with respect to another one of the print units according to the desired head arrangement.

4. The method of claim 1 comprising:

performing an optimization calculation based at least on nozzle status data;

selecting a desired head arrangement based on the calculation; and moving at least one of the print units with respect to another one of the print units according to the desired head arrangement.

5. The method of claim 1 comprising:

inspecting the idle print unit to receive print head data.

6. The method of claim 5 comprising:

performing one or more maintenance operations based on the print head data.

7. The method of claim 6, wherein performing the one or more maintenance operations comprises performing calibration of the print unit.

8. The method of claim 7, wherein performing the one or more maintenance operations comprises adjusting printing parameters.

9. The method of claim 8, wherein adjusting printing parameters comprises adjusting jetting pulse, pulse shape, temperature and amplitude.

10. The method of claim 1 comprising:

sending an alert indicating that replacement of one or more print heads of the idle print unit is needed.

11. The method of claim 1 comprising:

identifying malfunctioning nozzles at the idle print unit.

12. The method of claim 1 comprising:

replacing one or more of the print heads of the idle print unit.

13. The method of claim 1 comprising:

determining current functionality of each of the print units;

designating, based on the current functionality, one or more of the print units as active print units;

designating, based on the current functionality, one of the print units as a compensating print unit; and moving the compensating print unit to a desired position to compensate for defect nozzles at one or more of the active print units.

14. The method of claim 1 comprising:

maintaining substantially even distribution of workload between nozzles within the print unit by moving the print unit with respect to the other print units to enable activation of previously inactive nozzles.

15. A deposition printing method, the method comprising:

printing from two or more print units, each of the print units having one or more print heads together forming a head arrangement; and moving during printing at least one of the print units with respect to another one of the print units to dynamically change the head arrangement by:

selecting one of the print units as an idle print unit;

moving the idle print unit to a maintenance area during printing; and performing one or more maintenance operations on the idle print unit.

16. The method of claim 15, comprising:

moving the idle print unit to the print area;

designating the idle print unit as an active print unit; and selecting another one of the print units as the idle print unit.

17. A deposition printing method, the method comprising:

printing from two or more print units, each of the print units having one or more print heads together forming a head arrangement;

moving during printing at least one of the print units with respect to another one of the print units to dynamically change the head arrangement; and compensating for a defective nozzle by changing the position of at least one of the print units with respect to another one of the print units containing the defective nozzle.

18. A deposition printing method, the method comprising:

printing from two or more print units, each of the print units having one or more print heads together forming a head arrangement;

moving during printing at least one of the print units with respect to another one of the print units to dynamically change the head arrangement by:

determining current functionality of each of the print units;

designating, based on the current functionality, one or more of the print units as active print units;

designating, based on the current functionality, one of the print units as a compensating print unit;

moving the compensating print unit to a desired position to compensate for defect nozzles at one or more of the active print units; and changing functionality of the print units such that the compensating print unit is designated as active and one of the active print units is designating as compensating to maintain substantially even distribution of workload between the print units.

19. A deposition printing method, the method comprising:

printing from two or more print units, each of the print units having one or more print heads together forming a head arrangement; and moving during printing at least one of the print units with respect to another one of the print units to dynamically change the head arrangement wherein the printing is done by:

positioning two or more of the print units adjacent to each other such that nozzles of each of the print units are in precise alignment in a print direction relative to corresponding nozzles of other print units; and printing by interlacing drops from nozzles belonging to different print units to increase the speed of printing or the amount of material per dot.

20. A deposition printing method, the method comprising:

printing from two or more print units, each of the print units having one or more print heads together forming a head arrangement; and moving during printing at least one of the print units with respect to another one of the print units to dynamically change the head arrangement by moving at least one of the print heads with respect to the other print heads at a first direction to enable printing a first image with larger width and smaller print than prior to moving the print heads.

21. The method of claim 20 comprising:

moving at least one of the print heads with respect to the other print heads at a second direction, opposite to the first direction to enable printing a second image with smaller width and higher print resolution.

* * * * *